US008498421B2

(12) United States Patent
Jung et al.

(10) Patent No.: US 8,498,421 B2
(45) Date of Patent: Jul. 30, 2013

(54) METHOD FOR ENCODING AND DECODING MULTI-CHANNEL AUDIO SIGNAL AND APPARATUS THEREOF

(75) Inventors: Yang-Won Jung, Seoul (KR); Hee Suk Pang, Seoul (KR); Hyen-O Oh, Gyeonggi-do (KR); Dong Soo Kim, Seoul (KR); Jae Hyun Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 214 days.

(21) Appl. No.: 12/969,546

(22) Filed: Dec. 15, 2010

(65) Prior Publication Data

US 2011/0085669 A1 Apr. 14, 2011

Related U.S. Application Data

(63) Continuation of application No. 12/091,052, filed as application No. PCT/KR2006/004284 on Oct. 20, 2006, now abandoned.

(60) Provisional application No. 60/765,730, filed on Feb. 7, 2006, provisional application No. 60/734,292, filed on Nov. 8, 2005, provisional application No. 60/728,309, filed on Oct. 20, 2005.

(30) Foreign Application Priority Data

Jul. 28, 2006 (KR) ..... 10-2006-0071753

(51) Int. Cl.
*H04R 5/00* (2006.01)

(52) U.S. Cl.
USPC ..... 381/22; 381/23; 381/17; 704/E19.001; 704/E19.005; 704/E19.048; 704/501

(58) Field of Classification Search
USPC ..... 381/1, 17–18, 22–23; 704/500–501, 704/201, E19.001, E19.005, E19.048
See application file for complete search history.

(56) References Cited

U.S. PATENT DOCUMENTS 5,682,461 A 10/1997 Silzle et al.
6,774,820 B2 8/2004 Craven et al.

(Continued)

FOREIGN PATENT DOCUMENTS

DE 10350340 6/2005
JP 2007-531027 11/2007

(Continued)

OTHER PUBLICATIONS

Breebaart et al., "Parametric Coding of Stereo Audio," EURASIP Journal on Applied Signal Processing, 2005, vol. 9, pp. 1305-1322.

(Continued)

*Primary Examiner* — Disler Paul
(74) *Attorney, Agent, or Firm* — Fish & Richardson P.C.

(57) ABSTRACT

Methods and apparatuses for encoding and decoding a multi-channel audio signal are provided. In the encoding method, spatial information is calculated based on a multi-channel audio signal and a down-mix signal, and a compensation parameter that compensates for the down-mix signal is calculated based on the multi-channel audio signal and the down-mix signal. Thereafter, a bitstream is generated by encoding the spatial information, the compensation parameter, and the down-mix signal and combining the results of the encoding. Therefore, it is possible to prevent deterioration of the quality of sound regarding a multi-channel audio signal by compensating for the multi-channel audio signal using a compensation parameter that compensates for a down-mix signal.

12 Claims, 6 Drawing Sheets

U.S. PATENT DOCUMENTS

| | | | | |
|---|---|---|---|---|
| 7,394,903 | B2 | 7/2008 | Herre et al. | |
| 7,761,303 | B2 | 7/2010 | Pang et al. | |
| 7,991,494 | B2 * | 8/2011 | Pang et al. | 700/94 |
| 8,255,211 | B2 * | 8/2012 | Vinton et al. | 704/229 |
| 2004/0070523 | A1 | 4/2004 | Craven et al. | |
| 2005/0135643 | A1 | 6/2005 | Lee et al. | |
| 2005/0157883 | A1 | 7/2005 | Herre et al. | |
| 2005/0177360 | A1 | 8/2005 | Schuijers et al. | |
| 2005/0180579 | A1 | 8/2005 | Baumgarte et al. | |
| 2006/0233379 | A1 | 10/2006 | Villemoes et al. | |
| 2007/0140499 | A1 | 6/2007 | Davis | |
| 2008/0002842 | A1 | 1/2008 | Neusinger et al. | |
| 2008/0170711 | A1 | 7/2008 | Breebaart et al. | |

FOREIGN PATENT DOCUMENTS

| | | |
|---|---|---|
| TW | 469718 | 12/2001 |
| TW | 487833 | 5/2002 |
| TW | 200939865 | 9/2009 |
| WO | 03/090208 | 10/2003 |
| WO | 2004/080125 | 9/2004 |
| WO | 2005/069274 | 7/2005 |
| WO | 2005/101370 | 10/2005 |

OTHER PUBLICATIONS

Office Action, U.S. Appl. No. 12/091,053, dated Jun. 23, 2011, 10 pages.

Supplementary European Search Report for European Patent Application No. 06799357, dated Jun. 23, 2009, 5 pages.

Moon, et al., "A multi-channel audio compression method with virtual source location information for MPEG-4 SAC", IEEE Trans. on Consumer Electronics, vol. 51, No. 4, Nov. 2005.

ISO/IEC JTC1/SC29 WG11/602, "Generic coding of moving pictures and associated audio", ISO/IEC 13818-2 Committee Draft, Nov. 1993, Seoul.

Kim, et al., "Improved channel level difference quantization for spatial audio coding", ETRI Journal, vol. 29, No. 1, Feb. 2007.

International Search Report in corresponding International Application No. PCT/KR2006/004286 dated Jan. 24, 2007, 4 pages.

Beack, S. et al., "An Efficient Representation Method for ICLD with Robustness to Spectral Distortion", ETRI Journal, Jun. 2005, 4 pages.

Taiwanese Office Action dated Apr. 9, 2010 for Taiwan Patent Application No. 95138759, 5 pages.

Breebaart, et al., "MPEG Spatial Audio Coding/MPEG Surround: Overview and Current Status," Convention Paper, Audio Engineering Society 119th Convention, New York, New York, Oct. 7-10, 2005, pp. 1-17.

Herre, et al., "The Reference Model Architecture for MPEG Spatial Audio Coding," Convention Paper 6447, Audio Engineering Society 118th Convention, Barcelona, Spain, May 28-31, 2005, pp. 1-13.

Office Action, Chinese Appln. No. 200680038590.0, dated Sep. 23, 2011, 23 pages with English translation.

Office Action, U.S. Appl. No. 12/830,134, dated May 17, 2012, 10 pages.

Office Action, U.S. Appl. No. 12/091,053, dated Apr. 6, 2012, 20 pages.

Herre et al., "The Reference Model Architecture for MPEG Spatial Audio Coding," Convention Paper 6447, Audio Engineering Society, 118th Convention, Barcelona, Spain, May 28-31, 2005, 13 pages.

Notice of Allowance in Taiwan Application No. 097151237, dated Nov. 19, 2012, 4 pages.

* cited by examiner

METHOD FOR ENCODING AND DECODING MULTI-CHANNEL AUDIO SIGNAL AND APPARATUS THEREOF

CROSS-REFERENCE TO RELATED APPLICATIONS

This application is a continuation of, and claims priority to, pending U.S. application Ser. No. 12/091,052, filed Jun. 25, 2008, entitled "Method for Encoding and Decoding Multi-Channel Audio Signal and Apparatus Thereof," which is a U.S. national phase application under 35 U.S.C. §371(c) of International Application No. PCT/KR2006/004284, which claims the benefit of U.S. Provisional Application No. 60/728,309, filed Oct. 20, 2005, U.S. Provisional Application No. 60/734,292, filed Nov. 8, 2005, U.S. Provisional Application No. 60/765,730, filed Feb. 7, 2006 and Korean Application No. 10-2006-0071753, filed Jul. 28, 2006, the entire disclosures of each of which are incorporated herein by reference.

TECHNICAL FIELD

The present invention relates to an encoding method and apparatus and a decoding method and apparatus, and more particularly, to an encoding method and apparatus and a decoding method and apparatus in which a multi-channel audio signal can be encoded or decoded using additional information that can compensate for a down-mix signal.

BACKGROUND ART

In a typical method of encoding a multi-channel audio signal, a multi-channel audio signal is down-mixed into a mono or stereo signal and the mono or stereo signal is encoded together with spatial information, instead of encoding each channel of the multi-channel audio signal. Here, the spatial information is used to restore the original multi-channel audio signal.

FIG. 1 is a block diagram of a typical system for encoding/decoding a multi-channel audio signal. Referring to FIG. 1, an audio signal encoder includes a down-mix module which generates a down-mix signal by down-mixing a multi-channel audio signal into a stereo or mono signal, and a spatial parameter estimation module which generates spatial information. The system may receive an artistic down-mix signal that is processed externally, instead of generating a down-mix signal. An audio signal decoder interprets the spatial information generated by the spatial parameter estimation module, and restores the original multi-channel audio signal based on the results of the interpretation. However, during the generation of a down-mix signal by the audio signal encoder or during the generation of an artistic down-mix signal, signal level attenuation is likely to occur in the process of adding up different channel signals. For example, in the case of adding up two channels respectively having levels L1 and L2, the two channels do not overlap but offset each other so that a level DL12 of a channel obtained by the addition is lower than the sum of L1 and L2.

Attenuation of the level of a down-mix signal may cause signal distortion during a decoding operation. For example, the relationship between the levels of channels can be determined based on Channel Level Difference (CLD) information, which is a type of spatial information and indicates the difference between the levels of channels. However, when the level of a down-mix signal obtained by adding up the channels is attenuated, the level of a down-mix signal obtained by decoding is lower than the level of the original down-mix signal.

As a result of the aforementioned phenomenon, a multi-channel audio signal obtained by decoding may be boosted or suppressed at a predetermined frequency, thereby causing deterioration of the quality of sound. In addition, since the degree of attenuation of the level of a signal caused by a partial offset of the signal by another signal varies from one frequency domain to another, the degree of distortion of a signal after passing the signal through an audio encoder and an audio decoder also varies from one frequency to another. This problem cannot be fully addressed by varying the energy level of a down-mix signal in a predetermined frequency domain.

DISCLOSURE OF INVENTION

Technical Problem

The present invention provides an encoding method and apparatus in which a multi-channel audio signal can be encoded using additional information that can compensate for a down-mix signal.

The present invention also provides a decoding method and apparatus in which a multi-channel audio signal can be decoded using additional information that can compensate for a down-mix signal.

Technical Solution

According to an aspect of the present invention, there is provided a decoding method. The decoding method includes extracting a down-mix signal and additional information from an input signal, extracting spatial information and a compensation parameter from the additional information, generating a multi-channel audio signal based on the down-mix signal and the spatial information, and compensating for the multi-channel audio signal based on the compensation parameter.

According to another aspect of the present invention, there is provided a decoding apparatus. The decoding apparatus includes a demultiplexer which extracts an encoded down-mix signal and additional information from an input signal, a core decoder which generates a down-mix signal by decoding the encoded down-mix signal, a parameter decoder which extracts spatial information and a compensation parameter from the additional information, and a multi-channel synthesization unit which generates a multi-channel audio signal based on the down-mix signal and the spatial information and compensates for the multi-channel audio signal using the compensation parameter.

According to another aspect of the present invention, there is provided an encoding method. The encoding method includes calculating spatial information based on a multi-channel audio signal and a down-mix signal, and calculating a compensation parameter based on the multi-channel audio signal and the down-mix signal, the compensation parameter compensating for the down-mix signal.

According to another aspect of the present invention, there is provided an encoding apparatus. The encoding apparatus includes a spatial information calculation unit which calculates spatial information based on a multi-channel audio signal and a down-mix signal, a compensation parameter calculation unit which calculates a compensation parameter based on the multi-channel audio signal and the down-mix signal, the compensation parameter compensating for the down-mix signal, and a bitstream generation unit which generates a bitstream by encoding the spatial information, the compensation parameter, and the down-mix signal and combining the results of the encoding According to another aspect of the present invention, there is provided a computer-readable recording medium having recorded thereon a program for executing the decoding method.

According to another aspect of the present invention, there is provided a computer-readable recording medium having recorded thereon a program for executing the encoding method.

Advantageous Effects

In the encoding method, spatial information is calculated based on a multi-channel audio signal and a down-mix signal, and a compensation parameter that compensates for the down-mix signal is calculated based on the multi-channel audio signal and the down-mix signal. Thereafter, a bitstream is generated by encoding the spatial information, the compensation parameter, and the down-mix signal and combining the results of the encoding. Therefore, it is possible to prevent deterioration of the quality of sound regarding a multi-channel audio signal by compensating for the multi-channel audio signal using a compensation parameter that compensates for a down-mix signal.

BRIEF DESCRIPTION OF DRAWINGS

The above and other features and advantages of the present invention will become more apparent by describing in detail exemplary embodiments thereof with reference to the attached drawings in which.

BEST MODE FOR CARRYING OUT THE INVENTION

The present invention will now be described more fully with reference to the accompanying drawings in which exemplary embodiments of the invention are shown.

An encoding method and apparatus and a decoding method and apparatus according to an embodiment of the present invention can be applied to the processing of a multi-channel audio signal. However, the present invention is not restricted thereto. In other words, the present invention can also be applied to the processing of a signal other than a multi-channel audio signal.

Figure 2:
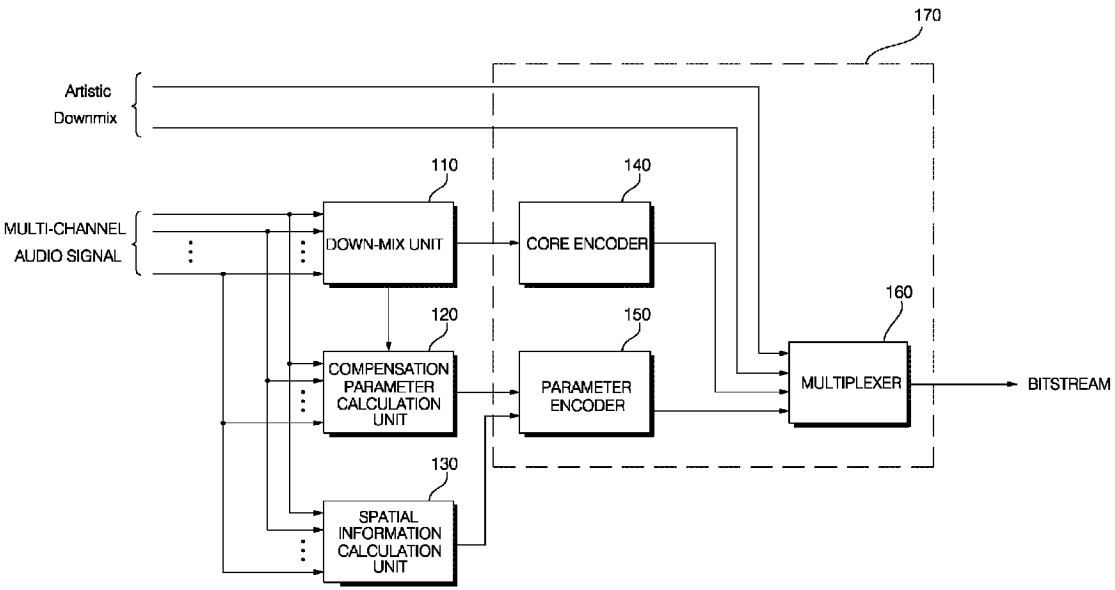
FIG. 2 is a block diagram of an encoding apparatus according to an embodiment of the present invention.

FIG. 2 is a block diagram of an encoding apparatus according to an embodiment of the present invention. Referring to FIG. 2, the encoding apparatus includes a down-mix unit 110, a compensation parameter calculation unit 120, a spatial information calculation unit 130, and a bitstream generation unit 170. The bitstream generation unit 170 includes a core encoder 140, a parameter encoder 150, and a multiplexer 160.

The down-mix unit 110 generates a down-mix signal by down-mixing an input multi-channel audio signal into a mono signal or a stereo signal. The compensation parameter calculation unit 120 compares the level or envelope of the down-mix signal generated by the down-mix unit 110 or an input artistic down-mix signal with the level or envelope of a multi-channel audio signal that is used to generate the generated down-mix signal or the input artistic down-mix signal and calculates a compensation parameter that is needed to compensate for a down-mix signal based on the results of the comparison. The spatial information calculation unit 130 calculates spatial information of a multi-channel audio signal.

The core encoder 140 of the bitstream generation unit 170 encodes a down-mix signal. The parameter encoder 150 generates additional information by encoding the compensation parameter and the spatial information. Then, the multiplexer 160 generates a bitstream by combining the encoded down-mix signal and the additional information. In detail, the down-mix unit 110 generates a down-mix signal by down-mixing the input multi-channel audio signal. For example, in the case of down-mixing a multi-channel audio signal with five channels (i.e., channels 1 through 5) into a stereo signal, down-mix channel 1 can be obtained by combining channels 1, 3, and 4 of the multi-channel audio signal, and down-mix channel 2 can be obtained by combining channels 2, 3, and 5 of the multi-channel audio signal.

Figure 1:
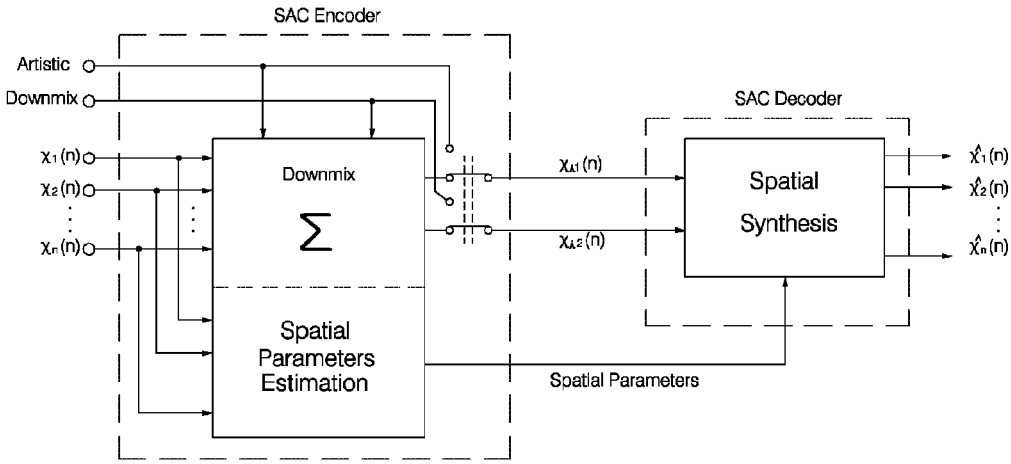
FIG. 1 is a block diagram of a typical system for encoding/decoding a multi-channel audio signal.

Once a down-mix signal is generated, the compensation parameter calculation unit 120 calculates a compensation parameter that is needed to compensate for the down-mix signal. The compensation parameter may be calculated using various methods. For example, assume that a multi-channel audio signal comprises five channels belonging to a predetermined frequency band, i.e., channels 1, 2, 3, 4, and 5, that L1, L2, L3, L4, and L5 respectively indicate the levels of channels 1, 2, 3, 4, and 5, that down-mix channel 1 is comprised of channels 1, 3, and 4, and that down-mix channel 2 is comprised of channels 2, 3, and 5. In this case, the level DL134 of down-mix channel 1 and the level DL235 of down-mix channel 2 can be represented by Equation (1):

$$DL134 \leqq L1+g3*L3+g4*L4$$

$$DL235 \leqq L2+g3*L3+g5*L5 \qquad \text{Math FIG. 1}$$

where g3, g4, and g5 indicate gains that are generated during a down-mix operation. In the case of generating a multi-channel audio signal based on a down-mix signal through decoding, the levels L1', L2', L3', L4' and L5' of five channels of the generated multi-channel audio signal are ideally the same as the original levels L1, L2, L3, L4, and L5, respectively, of five channels of an original multi-channel audio signal. In order to achieve this, a compensation parameter CF123 for down-mix channel 1 and a compensation parameter CF235 for down-mix channel 2 can be calculated using Equation (2):

$$CF134=(L1+g3*L3+g4*L4)/DL134$$

$$CF235=(L2+g3*L3+g5*L5)/DL235 \qquad \text{Math FIG. 2}$$

According to the present embodiment, a compensation parameter is calculated for each down-mix channel in order to reduce the amount of data to be transmitted. However, a compensation parameter may be calculated for each channel of a multi-channel audio signal. In other words, a compensation parameter may be calculated as the ratio of the energy of a down-mix signal and the energy of each channel of a multi-channel audio signal, or the ratio of the envelope of a down-mix signal and the envelope of each channel of a multi-channel audio signal.

The spatial information calculation unit 130 calculates spatial information. Examples of the spatial information include Channel Level Difference (CLD) information, Inter-channel Cross Correlation (ICC) information, and Channel Prediction Coefficient (CPC) information.

The core encoder 140 encodes a down-mix signal. The parameter encoder 150 generates additional information by encoding spatial information and a compensation parameter. The compensation parameter may be encoded using the same method used to encode a CLD. For example, the compensation parameter may be encoded using a time- or frequency-differential coding method, a grouped Pulse Code Modulation (PCM) coding method, a pilot-based coding method, or a Huffman codebook method. The multiplexer 160 generates a bitstream by combining an encoded down-mix signal and additional information. In this manner, a bitstream comprising, as additional information, a compensation parameter that compensates for the attenuation of the level of a down-mix signal can be generated.

In the situation when no level compensation is needed, a flag regarding a compensation parameter may be set to a value of 0, thereby reducing the bitrate of additional information. If there is no large difference between the values of the compensation parameters CF134 and CF235, only one of the compensation parameters CF134 and CF235 that can represent both the compensation parameters CF134 and CF235 may be transmitted, instead of transmitting both the compensation parameters CF134 and CF235. Also, if the value of a compensation parameter does not vary over time but is uniformly maintained, a predetermined flag may be used to indicate that a previous compensation parameter value can be used.

According to the present embodiment, a compensation parameter may be set based on the result of comparing the level of an input multi-channel audio signal with the level of a down-mix signal. However, a compensation parameter may be set or estimated using a different method from that set forth herein. In other words, since a compensation parameter models attenuation of the level of a down-mix signal compared to the level of an input multi-channel audio signal used to generate the down-mix signal, a compensation parameter can be defined as a level ratio, wave-format data, or a gain compensation value having a linear/nonlinear property. By using such a mathematically modeled value as a compensation parameter value, it is possible to efficiently transmit the compensation parameter and compensate for a down-mix signal using only a few bits.

Figure 3:
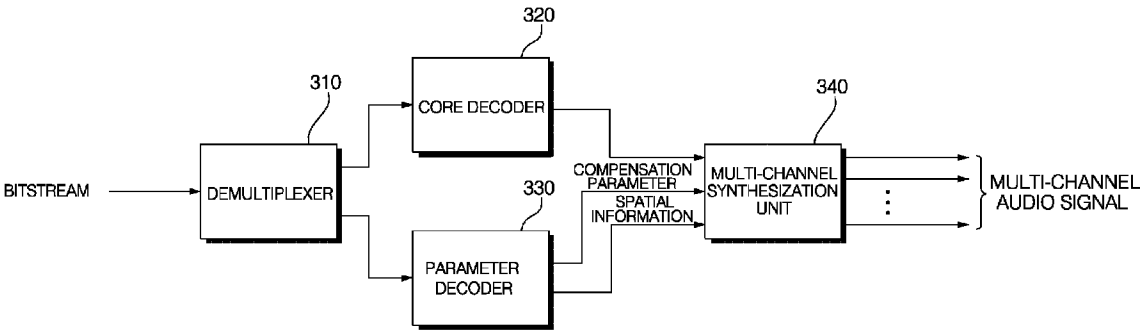
FIG. 3 is a block diagram of a decoding apparatus according to an embodiment of the present invention.

FIG. 3 is a block diagram of a decoding apparatus according to an embodiment of the present invention. Referring to FIG. 3, the decoding apparatus includes a demultiplexer 310, a core decoder 320, a parameter decoder 330, and a multi-channel synthesization unit 340.

The demultiplexer 310 demultiplexes additional information and an encoded down-mix signal from an input bitstream. The core decoder 320 generates a down-mix signal by decoding the encoded down-mix signal. The parameter decoder 330 generates spatial information and a compensation parameter based on the additional information obtained by the demultiplexer 310. The multi-channel synthesization unit 340 generates a multi-channel audio signal based on the down-mix signal obtained by the core decoder 320 and the spatial information and the compensation parameter obtained by the parameter decoder 330.

Figure 4:
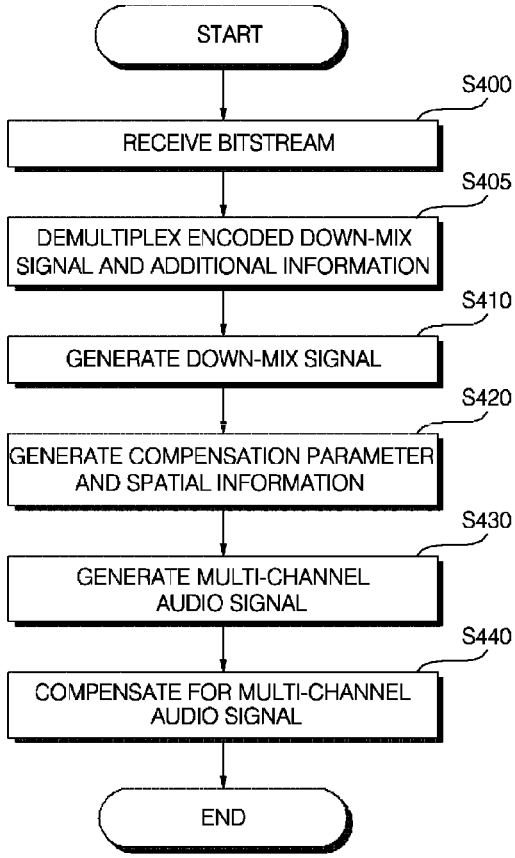
FIG. 4 is a flowchart illustrating the operation of the decoding apparatus illustrated in FIG. 3, according to an embodiment of the present invention.

FIG. 4 is a flowchart illustrating the operation of the decoding apparatus illustrated in FIG. 3, according to an embodiment of the present invention. Referring to FIGS. 3 and 4, in operation S400, a bitstream of a multi-channel audio signal is received. In operation S405, the demultiplexer 310 demultiplexes an encoded down-mix signal and additional information from the received bitstream. In operation S410, the core decoder 320 generates a down-mix signal by decoding the encoded down-mix signal. In operation S420, the parameter decoder 330 generates a compensation parameter and spatial information by decoding the additional information. In operation S430, the multi-channel synthesization unit 340 generates a multi-channel audio signal based on the spatial information and the down-mix signal. In operation S440, the multi-channel synthesization unit 340 compensates for the multi-channel audio signal using the compensation parameter. In detail, the multi-channel synthesization unit 340 may compensate for the output of each of a plurality of channels that are obtained based on a down-mix signal and spatial information through decoding, as indicated by Equation (3):

$$L1''=L1'*CF134$$

$$L2''=L2'*CF235$$

$$L3''=L3'*(CF124+CF235)/2$$

$$L4''=L4'*CF134$$

$$L5''=L5'*CF235$$

Math FIG. 3 where L1', L2', L3', L4' and L5' indicate the energy levels of the channels and CF124 and CF235 indicate compensation parameters.

In this manner, it is possible to prevent signal distortion at a predetermined frequency by using a compensation parameter that is received along with spatial information during a decoding operation so that a multi-channel audio signal obtained as a result of the decoding operation can be properly compensated for. According to the present embodiment, the output of each channel is compensated for using a compensation parameter. However, the present invention is not restricted thereto. In other words, when the envelope of each channel is transmitted as a compensation parameter, spatial information does not need to be transmitted because spatial information can be generated based on information regarding the envelope of each channel. Even when no spatial information is received, a decoding apparatus can extract pseudo spatial information from an input down-mix signal with two or more down-mix channels, and decode the input down-mix signal based on the pseudo spatial information.

Figure 5:
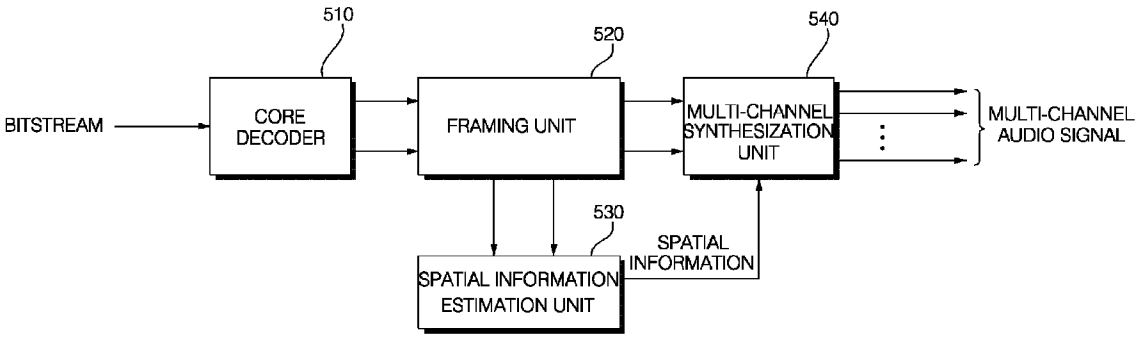
FIG. 5 is a block diagram of a decoding apparatus according to another embodiment of the present invention.

FIG. 5 is a block diagram of a decoding apparatus according to an embodiment of the present invention. Referring to FIG. 5, the decoding apparatus does not use spatial information as additional information and generates a multi-channel audio signal only based on a down-mix signal.

Referring to FIG. 5, the decoding apparatus includes a core decoder 510, a framing unit 520, a spatial information estimation unit 530, and a multi-channel synthesization unit 540.

The core decoder 510 generates a down-mix signal by decoding an input bitstream, and transmits the down-mix signal to the framing unit 520. The down-mix signal may be a matrix-type down-mix signal obtained by using, for example, Prologic or Logic7, but the present invention is not restricted to this.

The framing unit 520 arrays data regarding the down-mix signal obtained by the core decoder 510 so that the corresponding down-mix signal can be synchronized in units of spatial audio coding (SAC) frames. During this framing operation, if quadrature mirror filter (QMF) and hybrid band domain signals are generated based on the down-mix signal obtained by the core decoder 510 by using an analysis filter bank, then the framing unit 520 may transmit hybrid band domain signals to the multi-channel synthesization unit 540 because hybrid band domain signals can be readily used in a decoding operation.

The spatial information estimation unit 530 generates spatial information such as CLD, ICC, and CPC information based on a down-mix signal obtained by the framing unit 520. In detail, the spatial information estimation unit 530 generates spatial information for each SAC frame. In this case, the spatial information estimation unit 530 may gather data of a down-mix signal until the length of gathered data combined becomes the same as that of a frame, and then process the gathered down-mix signal data. Alternatively, the spatial information estimation unit 530 may generate spatial information for each PCM sample. The spatial information generated by the spatial information estimation unit 530 is not data to be transmitted, and thus does not need to be subjected to compression such as quantization. Accordingly, the spatial information generated by the spatial information estimation unit 530 may contain as much information as possible.

The multi-channel synthesization unit 540 generates a multi-channel audio signal based on the down-mix signal obtained by the framing unit 520 and the spatial information generated by the spatial information estimation unit 530.

According to the present embodiment, it is possible to reduce bitrate compared to a conventional method that involves transmitting spatial information as additional information. In addition, it is possible to generate a multi-channel signal using the same method typically used to generate matrix-type down-mix content.

Figure 6:
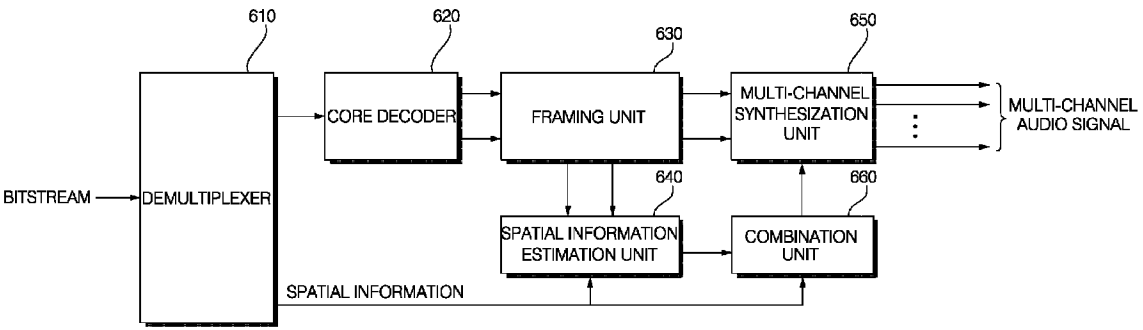
FIG. 6 is a block diagram of a decoding apparatus according to another embodiment of the present invention.

FIG. 6 is a block diagram of a decoding apparatus according to an embodiment of the present invention. Referring to FIG. 6, when a bitstream comprising not only a down-mix audio signal but also spatial information is received, the decoding apparatus generates additional spatial information based on the spatial information included in the received bitstream, and uses the additional spatial information to decode the down-mix audio signal.

Referring to FIG. 6, the decoding apparatus includes a demultiplexer 610, a core decoder 620, a framing unit 630, a spatial information estimation unit 640, a multi-channel synthesization unit 650, and a combination unit 650.

The demultiplexer 610 demultiplexes spatial information and an encoded down-mix signal from an input bitstream. The core decoder 620 generates a down-mix signal by decoding the encoded down-mix signal. The framing unit 630 arrays data regarding the down-mix signal obtained by the core decoder 510 so that the corresponding down-mix signal can be synchronized in units of spatial audio coding (SAC) frames. The spatial information estimation unit 640 generates additional spatial information through estimation based on the spatial information obtained by the demultiplexer 610. The combination unit 660 combines the spatial information obtained by the demultiplexer 610 and the additional spatial information generated by the spatial information estimation unit 640, and transmits spatial information obtained by the combination to the multi-channel synthesization unit 650. Then, the multi-channel synthesization unit 650 generates a multi-channel audio signal based on the down-mix signal generated by the core decoder 620 and the spatial information transmitted by the combination unit 660.

According to the present embodiment, not only spatial information included in an input bitstream but also additional spatial information obtained from a down-mix signal through estimation can be used. A variety of applications are possible according to the type of spatial information included in an input bitstream, and this will hereinafter be described in detail.

When spatial information comprising only a few time slots and data bands is received, i.e., when the bitrate of spatial information is so low that the number of data bands of the spatial information or the transmission frequency of the spatial information is low, the spatial information estimation unit 640 generates information lacked by the spatial information based on the spatial information and a down-mix PCM signal, thereby enhancing the quality of a multi-channel audio signal. For example, if spatial information comprising only five data bands is received, the spatial information estimation unit 640 may convert the spatial information into spatial information comprising twenty eight data bands with reference to a down-mix signal that is received along with the spatial information. If spatial information comprising only two time slots is received, the spatial information estimation unit 640 may generate a total of eight time slots through interpolation with reference to a down-mix signal that is received along with the spatial information.

When only part of spatial information including CLD, ICC, and CPD information is received, e.g., when only ICC information is received, the spatial information estimation unit 640 may generate CLD and CPC information through estimation, thereby enhancing the quality of a multi-channel audio signal. Likewise, when only CLD information is received, the spatial information estimation unit 640 may generate ICC information through estimation.

An encoding apparatus down-mixes an input multi-channel signal into a down-mix signal using One-To-Two (OTT) or Two-To-Three (TTT) boxes. When spatial information corresponding to only some OTT or TTT boxes is received, the spatial information estimation unit 640 may generate spatial information corresponding to other OTT or TTT boxes through estimation, and generate a multi-channel audio signal based on the received spatial information and the generated spatial information. In this case, the estimation of spatial information may be performed after SAC-decoding the received spatial information. For example, if a down-mix signal with two channels (i.e., left (L) and right (R) channels) and spatial information corresponding to TTT boxes is received, the spatial information estimation unit 640 may generate L-, center (C)-, and (R)-channel signals based on the L and R channels signals of the received down-mix signal.

Thereafter, the spatial information estimation unit 640 may generate spatial information corresponding to OTT boxes. Then, the multi-channel synthesization unit 650 generates a multi-channel audio signal based on the received spatial information and the spatial information generated by the spatial information estimation unit 640. This method can be applied to the situation when the number of output channels is large. For example, when a bitstream having a 525 format is input to a decoding apparatus that can provide up to seven channels, the decoding apparatus generates five channel signals (hybrid domain) through SAC decoding, generates through estimation spatial information that is needed to expand the five channel signals to seven channels, and additionally perform decoding, thereby generating a signal with more channels than can be provided by a single bitstream.

The present invention can be realized as computer-readable code written on a computer-readable recording medium. The computer-readable recording medium may be any type of recording device in which data is stored in a computer-readable manner. Examples of the computer-readable recording medium include a ROM, a RAM, a CD-ROM, a magnetic tape, a floppy disc, an optical data storage, and a carrier wave (e.g., data transmission through the Internet). The computer-readable recording medium can be distributed over a plurality of computer systems connected to a network so that computer-readable code is written thereto and executed therefrom in a decentralized manner. Functional programs, code, and code segments needed for realizing the present invention can be easily construed by one of ordinary skill in the art.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, it is possible to compensate for a multi-channel audio signal obtained by decoding using, as additional information, a compensation parameter that is calculated by comparing the level of an input multi-channel audio signal with the level of a down-mix signal. In addition, according to the present invention, it is possible to generate additional spatial information based on input spatial information and an input down-mix signal. Therefore, it is possible to prevent a multi-channel audio signal obtained through decoding from being distorted at a predetermined frequency and improve the quality of the multi-channel audio signal.

According to the present invention, it is possible to prevent deterioration of the quality of sound by compensating for a down-mix signal using a compensation parameter during the encoding and/or decoding of a multi-channel audio signal.

What is claimed is:

1. A decoding method comprising:

extracting, by an audio decoding apparatus, a down-mix signal and additional information from an input signal;

extracting, by the audio decoding apparatus, compensation information from the additional information, the compensation information indicating whether a compensation parameter is applied to a second multi-channel audio signal;

extracting, by the audio decoding apparatus, spatial information and the compensation parameter from the additional information, the compensation parameter relating an envelope of the down-mix signal to an envelope of a first multi-channel audio signal that is used to generate the down-mix signal;

generating, by the audio decoding apparatus, the second multi-channel audio signal based on the down-mix signal and the spatial information; and compensating, by an audio decoding apparatus, the envelope of each channel of the second multi-channel audio signal based on the compensation parameter when the compensation information indicates the compensation parameter is applied to the second multi-channel audio signal.

2. The decoding method of claim 1, wherein the compensation parameter is calculated by comparing the envelope of the down-mix signal and the envelope of the first multi-channel audio signal that is used to generate the down-mix signal.

3. The decoding method of claim 1, wherein the compensation parameter comprises ratio information of the envelope of the down-mix signal and the envelope of the first multi-channel audio signal.

4. The decoding method of claim 1, wherein the spatial information includes at least one of Channel Level Difference (CLD), Interchannel Cross Correlation(ICC), Channel Prediction Coefficient(CPC) information corresponding to One-To-Two (OTT) box or Two-To-Three (TTT) box.

5. A decoding apparatus comprising:

a demultiplexer which extracts an encoded down-mix signal and additional information from an input signal;

a core decoder which generates a down-mix signal by decoding the encoded down-mix signal;

a parameter decoder which extracts spatial information and a compensation parameter from the additional information, the compensation parameter relating an envelope of the down-mix signal to an envelope of a first multi-channel audio signal that is used to generate the down-mix signal, the parameter decoder which extracts compensation information indicating whether the compensation parameter is applied to a second multi-channel audio signal; and a multi-channel decoder which generates the second multi-channel audio signal based on the down-mix signal and the spatial information and compensates the envelope of each channel of the second multi-channel audio signal based on the compensation parameter when the compensation information indicates the compensation parameter is applied to the second multi-channel audio signal.

6. The decoding apparatus of claim 5, wherein the compensation parameter is calculated by comparing the envelope of the down-mix signal and the envelope of the first multi-channel audio signal that is used to generate the down-mix signal.

7. The decoding apparatus of claim 5, wherein the spatial information includes at least one of Channel Level Difference (CLD), Interchannel Cross Correlation(ICC), Channel Prediction Coefficient(CPC) information corresponding to One-To-Two (OTT) box or Two-To-Three (TTT) box.

8. The decoding apparatus of claim 5, wherein the compensation parameter comprises ratio information of the envelope of the down-mix signal and the envelope of the first multi-channel audio signal.

9. An encoding apparatus comprising:

a down-mix generation apparatus which generating a down-mix signal from a first multi-channel audio signal;

a spatial information calculation apparatus which calculates spatial information based on the multi-channel audio signal and the down-mix signal;

a compensation parameter calculation apparatus which generates compensation information indicating whether a compensation parameter is applied to a second multi-channel audio signal, the second multi-channel audio signal being constructed based on the down-mix signal and the spatial information, and calculates the compensation parameter based on the first multi-channel audio signal and the down-mix signal, the compensation parameter relating an envelope of the down-mix signal to an envelope of the first multi-channel audio signal, the compensation parameter being calculated for each channel of the second multi-channel audio signal when the compensation parameter is applied to the second multi-channel audio signal; and a bitstream generation apparatus which generates a bitstream by encoding the spatial information, the compensation information, the compensation parameter, and the down-mix signal and combining results of the encoding.

10. The encoding apparatus of claim 9, wherein the compensation parameter calculation apparatus calculates the compensation parameter by comparing the envelope of the down-mix signal and the envelope of the first multi-channel audio signal.

11. The encoding apparatus of claim 9, wherein the spatial information includes at least one of Channel Level Difference (CLD), Inter-channel Cross Correlation(ICC), Channel Prediction Coefficient(CPC) information corresponding to One-To-Two (OTT) box or Two-To-Three (TTT) box.

12. The encoding apparatus of claim 9, wherein the compensation parameter comprises ratio information of the envelope of the down-mix signal and the envelope of the first multi-channel audio signal.

* * * * *